US006998830B1

(12) United States Patent
Henry et al.

(10) Patent No.: US 6,998,830 B1
(45) Date of Patent: Feb. 14, 2006

(54) BAND-GAP REFERENCE

(75) Inventors: Paul M. Henry, Tucson, AZ (US); Wade A. Leitner, Tucson, AZ (US)

(73) Assignee: National Semiconductor Corporation, Santa Clara, CA (US)

( * ) Notice: Subject to any disclaimer, the term of this patent is extended or adjusted under 35 U.S.C. 154(b) by 355 days.

(21) Appl. No.: 10/619,945

(22) Filed: Jul. 14, 2003

(51) Int. Cl.
*G05F 3/16* (2006.01)
*G05F 3/20* (2006.01)

(52) U.S. Cl. ..... 323/316; 323/313; 327/539

(58) Field of Classification Search ..... 323/312, 323/313, 315, 316, 317; 327/530, 535, 538, 327/539–541; 330/288, 290, 296
See application file for complete search history.

(56) References Cited

U.S. PATENT DOCUMENTS 6,031,365 A * 2/2000 Sharpe-Geisler ..... 323/313
6,259,324 B1 * 7/2001 Antognetti et al. ..... 330/296
6,380,723 B1 * 4/2002 Sauer ..... 323/315
6,617,836 B1 * 9/2003 Doyle et al. ..... 323/316
6,639,451 B1 * 10/2003 Conte et al. ..... 327/538

* cited by examiner

*Primary Examiner*—Matthew V. Nguyen
(74) *Attorney, Agent, or Firm*—Merchant & Gould; Brett A. Hertzberg

(57) ABSTRACT

A reference circuit includes a band-gap core, two current sources, and an amplifier circuit that are arranged in cooperation. The band-gap core circuit is biased by current that is supplied from a local power supply via the first current source. The second current source shunts the excess away from the band-gap core circuit in response to a control signal. The control signal is provided by the amplifier circuit, which is arranged to monitor the signals in the band-gap core circuit. The feedback loop that is formed with the amplifier circuit is compensated with a capacitor that is not referenced to the local power supply. The first current source can be further improved by cascading. The reference circuit has excellent characteristics for use in switching applications, where the local supply is perturbed by fast switching transients.

20 Claims, 8 Drawing Sheets

BAND-GAP REFERENCE

FIELD OF THE INVENTION

The present invention is related to a method and system for generating a reference voltage. More particularly, the present invention is related to a CMOS band-gap reference voltage circuit that configured to minimize the effects of noise in the power-supply.

BACKGROUND OF THE INVENTION

Band-gap voltage references are used as voltage references in electronic systems. The energy band-gap of Silicon is on the order of 1.2V, and is independent from temperature and power-supply variations. Bipolar transistors have a negative temperature drift with respect to their base-emitter voltage (Vbe decreases as operating temperature increases on the order of −2 mV/deg C). However, the thermal voltage of a bipolar transistor has a positive temperature drift (Vt=kT/q, thus Vt increases as temperature increases). The positive temperature drift in the thermal voltage (Vt) may be arranged to compensate the negative temperature drift in the bipolar transistor's base-emitter voltage. Band-gap reference circuits use the inherent characteristics of bipolar transistors to compensate for temperature effects and provide a stable operating voltage over various power-supply and temperature ranges.

An example band-gap reference circuit is illustrated in FIG. 5. As shown in the figure, two bipolar transistors (Q51, Q52) are arranged with a common base. Two resistors (R51, R52) are series connected between the emitter of the first bipolar transistor (Q51) and the reference output. Another resistor (R53) is connected between the emitter of the second bipolar transistor and the reference output. An error amplifier (EAMP) is used to adjust the voltage of the reference output (VREF) via transistor MLDO. At steady-state, the voltage at the common point of resistors R51 and R52 is the same as the voltage at the emitter of the second bipolar transistor (Q55). The two bipolar transistors (Q51, Q52) are arranged to provide a ten-to-one (10:1) current density difference with respect to one another. The ten-to-one current density results in a 60 mV difference between the base-emitter voltages of two bipolar transistors $$(\Delta Vbe=Vt*1n(I1/I2)=26\ mV*1n(10)=60\ mV,$$

at room temperature). The 60 mV difference appears across the first resistor (R51). The voltage between the drain of transistor MLDO and ground provides a voltage reference (VREF) that is given as $$VREF=Vbe+X*Vt,$$

where X is a constant that is used to scale the temperature correction factor. The temperature correction factor (X) is adjusted by the ratio of the resistors. Typical temperature corrected reference voltages of 1.25V are achieved by this configuration.

BRIEF DESCRIPTION OF THE DRAWINGS

Non-limiting and non-exhaustive embodiments of the present invention are described with reference to the following drawings.

DETAILED DESCRIPTION OF THE PREFERRED EMBODIMENTS

Figure 1:
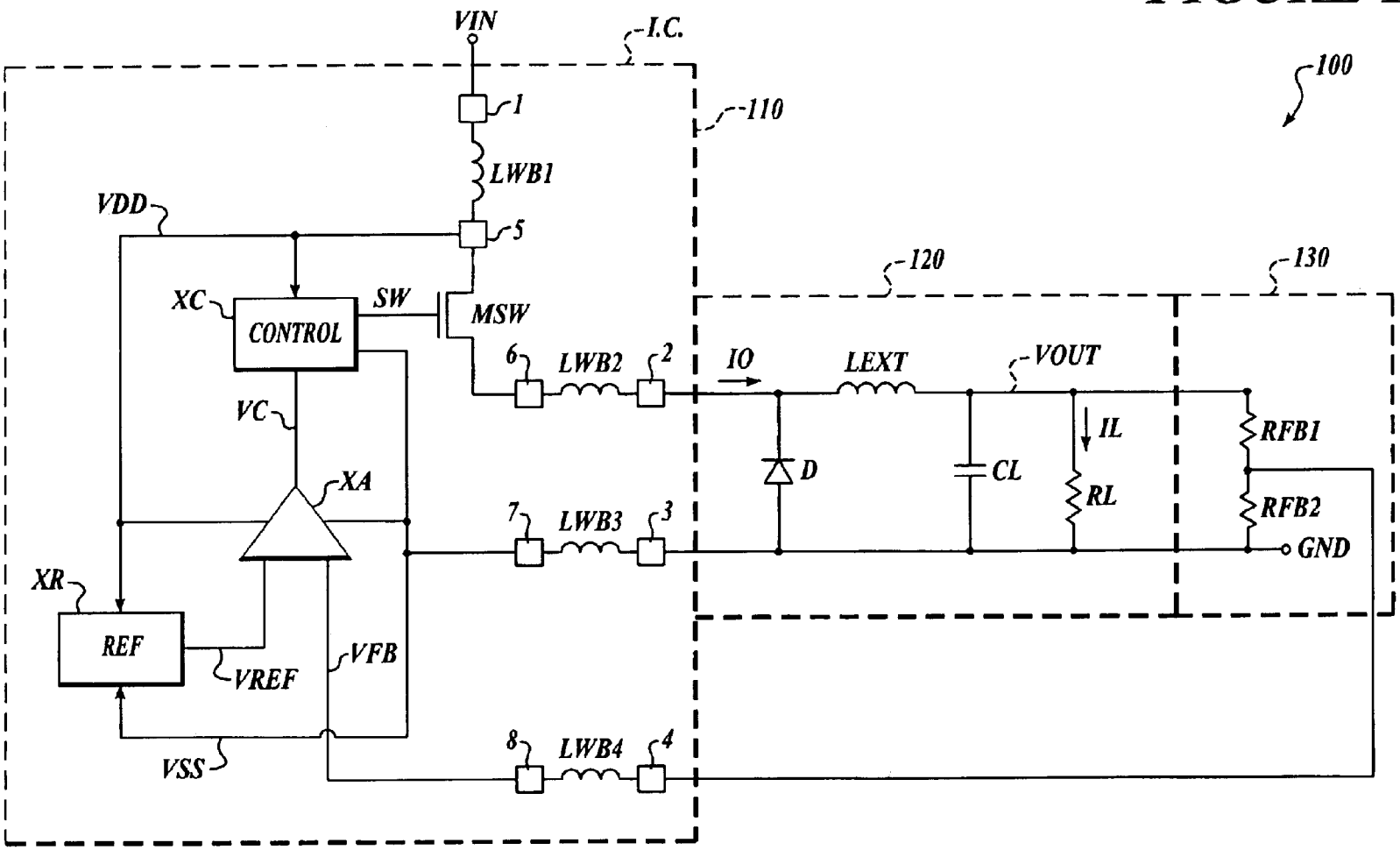
FIG. 1 is an illustrative schematic diagram for a switching-type regulator circuit that is arranged in accordance with an embodiment of the present invention.

Various embodiments of the present invention will be described in detail with reference to the drawings, where like reference numerals represent like parts and assemblies throughout the several views. Reference to various embodiments does not limit the scope of the invention, which is limited only by the scope of the claims attached hereto. Additionally, any examples set forth in this specification are not intended to be limiting and merely set forth some of the many possible embodiments for the claimed invention.

Throughout the specification and claims, the following terms take at least the meanings explicitly associated herein, unless the context clearly dictates otherwise. The meaning of "a,""an," and "the" includes plural reference. The meaning of "in" includes "in" and "on." The term "connected" means a direct connection between the items connected, without any intermediate devices. The tern "coupled" refers to both direct connections between the items connected, and indirect connections through one or more intermediary items. The term "circuit" may refer to both single components, and to a multiplicity of components. The term component refers to one or more items that are configured to provide a desired function. The term "signal" includes signals such as currents, voltages, charges, logic signals, data signals, optical signals, electromagnetic waves, as well as others. Referring to the drawings, like numbers indicate like parts throughout the views.

System Overview

Briefly stated, the present invention is related to a reference circuit that includes a band-gap core, two current sources, and an amplifier circuit that are arranged in cooperation. The band-gap core circuit is biased by current that is supplied from a local power supply via the first current source. The second current source shunts the excess away from the band-gap core circuit in response to a control signal. The control signal is provided by the amplifier circuit, which is arranged to monitor the signals in the band-gap core circuit. The feedback loop that is formed with the amplifier circuit is compensated with a capacitor that is not referenced to the local power supply. The first current source can be further improved by cascading. The reference circuit has excellent characteristics for use in switching applications, where the local supply is perturbed by fast switching transients.

FIG. 1 is an illustrative schematic diagram for a switching-type regulator circuit (100) that is arranged in accordance with an embodiment of the present invention. Circuit 100 includes a regulator circuit (110), an output circuit (120), and a feedback circuit (130).

Regulator circuit 110 includes a reference circuit (XR), a control circuit (XC), an amplifier (XA), a switching transistor (MSW), and a series of connection points (1–8). Connection points 1–4 represents the lead-frame connections in an integrated circuit (IC). Connection point 5–8 represent bonding pads on the integrated circuit die. Connections points 1 and 5 are coupled together by a bonding wire as represented by inductor LWB1. Connections points 2–4 are similarly coupled to connections points 6–8 via bonding wires that are represented by inductors LWB2–LWB4. Connection point 5 is arranged to supply a power signal (VDD) for regulator circuit 110. Connection point 7 is arranged to operate as a supply return (VSS) for regulator circuit 110. Connection point 8 is arranged to provide a feedback signal (VFB) to the amplifier circuit (XA). Reference circuit XR is arranged to provide a reference signal (VREF). Amplifier XA is arranged to compare the feedback signal (VFB) to the reference signal (VREF) and provide a control signal (VC). Control circuit XC is arranged to provide a switch control signal (SW) to switching transistor MSW. Switching transistor MSW is responsive to a switching control signal (SW) such that power is selectively coupled between connection points 5 and 6.

Output circuit 120 includes a diode (D), an inductor (Lext), a capacitor (CL) and a resistor (RL). Diode D is coupled between connection points 2 and 3 of regulator circuit 110. Inductor Lext is series coupled between connection point 2 and an output. Resistor RL is coupled in parallel with capacitor CL, which is coupled between the output and connection point 3 of the regulator circuit. Feedback circuit 130 includes series coupled resistors RFB1 and RFB2, which are coupled in parallel with resistor RL.

The regulator circuit (110), the output circuit (120), and the feedback circuit (130) are arranged to cooperate with one another to operate as a switching-type regulator. An unregulated power signal (VIN) is provided to connection point 1, while connection point 3 is arranged to operate as a power supply return, or signal ground. The output circuit includes a load that is represented as resistor RL. A feedback voltage is provided to connection point 4, where the feedback voltage corresponds to a percentage of the output voltage (VOUT) across resistor RL. Switching transistor MSW is selectively activated to couple an output current (Io) to the output circuit. Power is delivered to resistor RL and capacitor CL while inductor Lext is charging (when switching transistor MSW is activated). Power is principally delivered to resistor RL by inductor Lext as switching transistor MSW is periodically activated. Diode D operates as a freewheeling diode that provides a conduction path for inductor Lext when the output current (Io) is interrupted. Capacitor CL provides ripple reduction in the output voltage regulation.

Amplifier XA compares the feedback voltage (VFB) to the reference voltage (VREF) to provide a control signal (VC). The control circuit (XC) evaluates the control signal and provides a switch control signal (SW) to switching transistor MSW. A surge of current flows through inductor LWBI when switching transistor MSW is activated. The current surge creates a difference in the voltages associated with connection points 1 and 5. Connection point 5 operates as a local power supply (VDD) for regulator circuit 110, which is perturbed by the transient current that flows through inductor LWB1. Connection point 7 operates as another local supply (VSS), or a local ground, for regulator circuit 110, which is perturbed by the transient current that flows through inductor LWB3. Noise and other disturbances such as from the switching operation of transistor MSW are coupled into the local power supplies (VDD, VSS). Reference circuit XR is arranged to provide a reference signal (VREF) with minimal effects from variations in the local power supplies. The transient noise and local supply rejection characteristics of the reference circuit (XR) will become apparent from the discussion of various embodiments that are described below.

Example Reference Circuits

Figure 2A:
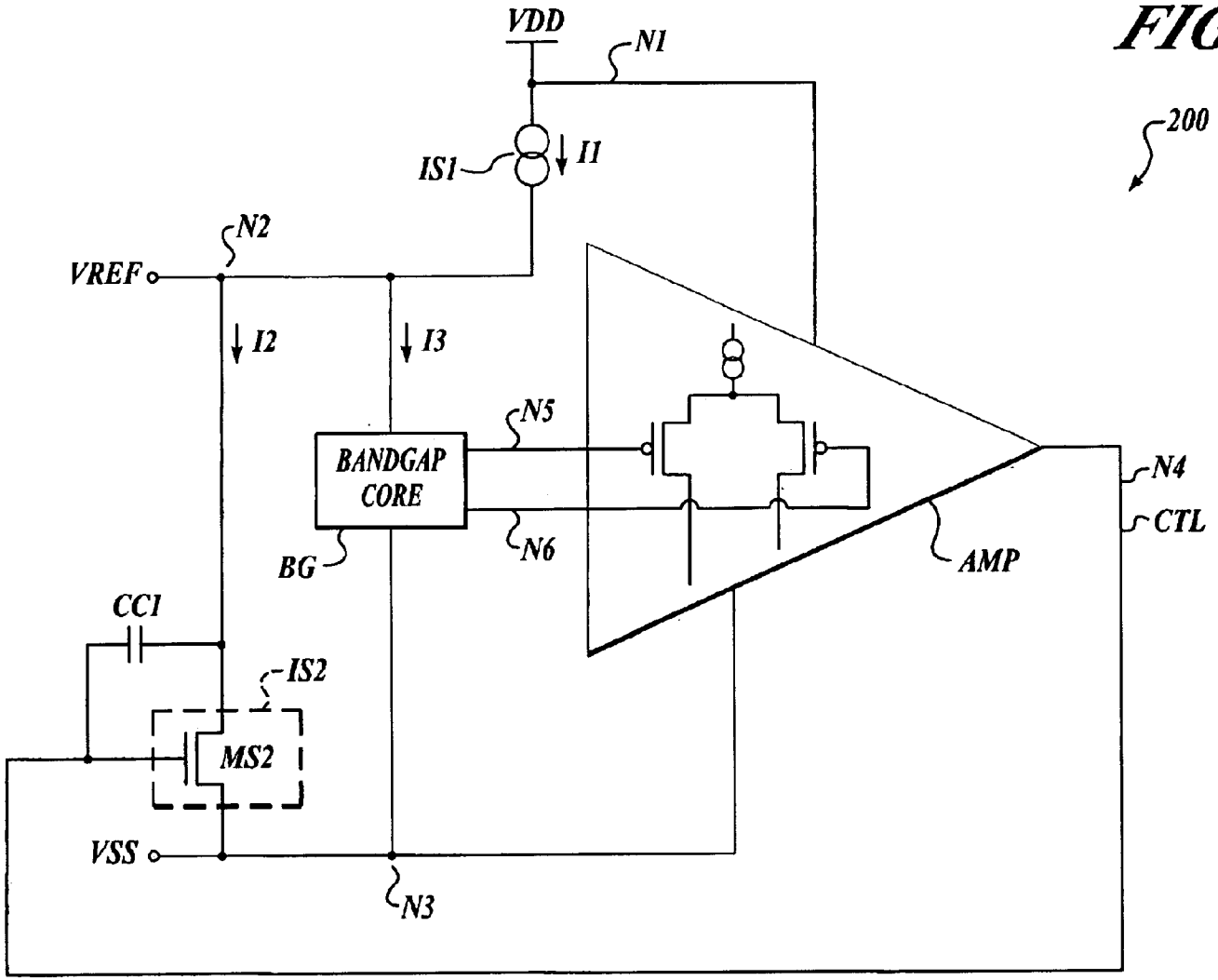
FIG. 2A is an illustrative schematic diagram for a band-gap reference circuit that is arranged in accordance with an embodiment of the present invention.

FIG. 2A is an illustrative schematic diagram for a band-gap reference circuit (200) that is arranged in accordance with an embodiment of the present invention. Circuit 200 includes an amplifier circuit (AMP), a band-gap core (BG), a current source (IS1), a controlled current source (IS2), and a compensation capacitor (CC1).

Current source IS1 is coupled between nodes N1 and N2. Controlled current source IS2 is coupled between nodes N2 and N3, and responsive to a control signal (CTL) from node N4. Band-gap core BG is coupled between nodes N2 and N3, and arranged to provide output signals to nodes N5 and N6. Amplifier circuit AMP is arranged to provide the control signal (CTL) at node N4 in response to the signals from nodes N5 and N6. Node N1 corresponds to a local power supply (e.g., VDD) for reference circuit 200, while node N3 corresponds to another local power supply (e.g., VSS) for the reference circuit. The signal associated with node N2 corresponds to the output of the reference circuit (VREF). Capacitor CC1 is coupled between nodes N2 and N4. Node N3 is arranged to operate as a signal ground for the reference circuit.

In operation, current source IS1 is arranged to provide a current (I1) to node N2. Controlled current source IS2 is arranged to selectively sink current (I2) from node N2 in response to the control signal (CTL). Band-gap core BG is biased by another current (I3) that corresponds to the difference between currents I1 and I2. The output of band-gap core BG is provided to amplifier circuit AMP. Capacitor CC1 is a compensation capacitor that stabilizes the loop formed with the amplifier. Amplifier circuit AMP is arranged as an error amplifier that selectively adjusts current I2 to maintain reference signal (VREF). For the example illustrated in FIG. 2A, amplifier AMP includes a p-type field effect transistor (FET) input stage.

Performance of reference circuit 200 is enhanced by referencing current source IS2 to the VSS supply, or signal ground. Noise and other transient events may create variations in the VDD supply. For example, the VDD supply may vary with fast transients that result in a switching regulator (see previous discussion). Amplifier AMP is arranged in cooperation with current source IS2 to maintain the voltage at node N2. Since current source IS2 is referenced to the signal ground (VSS), fast transients on the VDD supply do not directly affect current source IS2. Moreover, current source IS1 is a current source that does not directly couple the fast transients from the VDD supply to node N2.

Band-gap core BG can be any appropriate circuit that is arranged to operate as a band-gap circuit. The difference in the voltage associated with nodes N5 and N6 corresponds to the difference in the adjusted base-emitter voltages (or diode voltages) that are typically associated with band-gap circuits. Controlled current source IS2 is illustrated as a transistor that is configured to operate as a current source.

Figure 5:
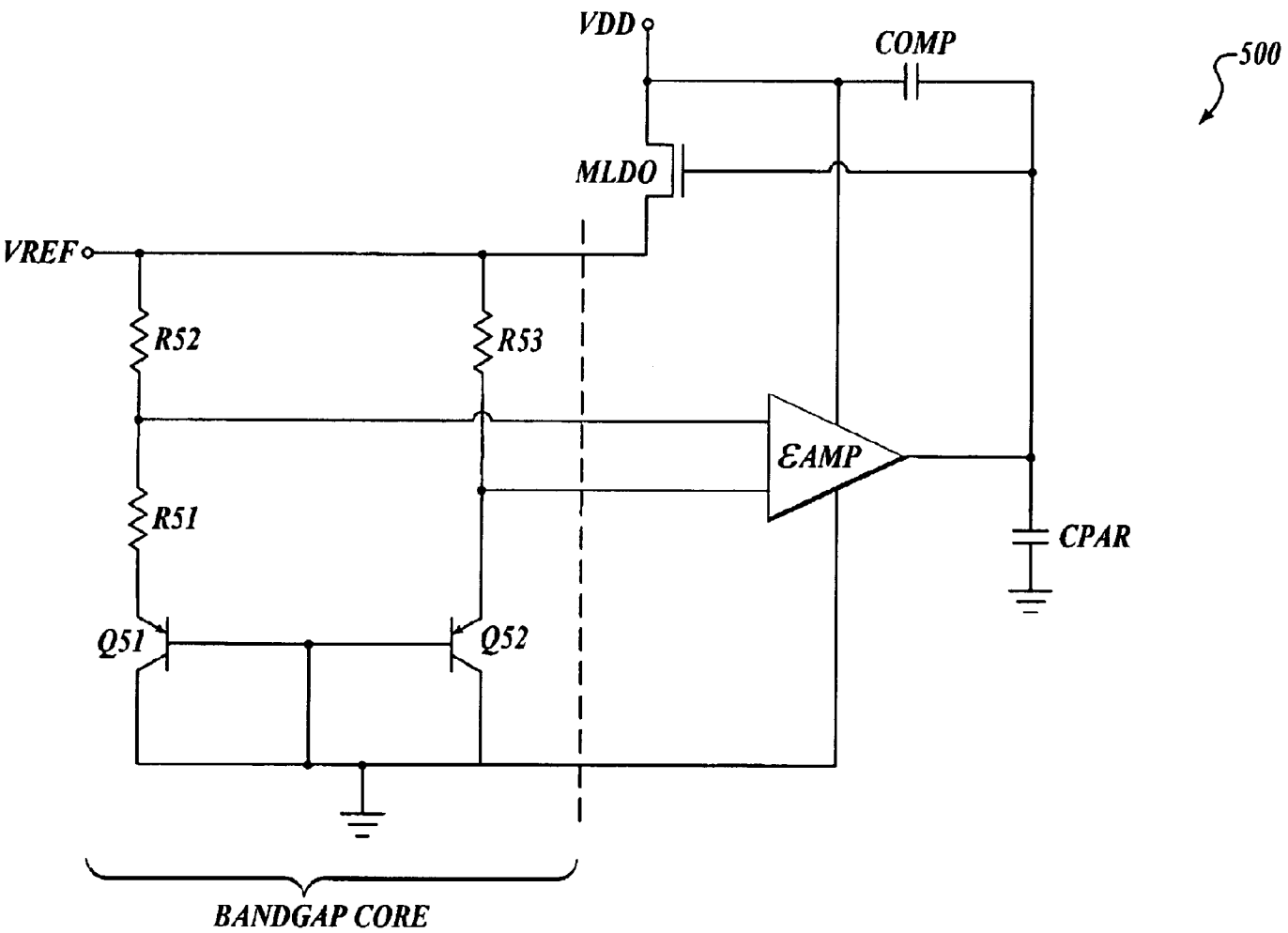
FIGURE 5. (PRIOR ART)
FIG. 5 is an illustrative schematic diagram for a conventional band-gap reference circuit.

In the conventional circuit shown in FIG. 5, the compensation capacitor (Comp) is coupled to the VDD supply and the output of the error amplifier. Noise and other fast transient events on the VDD supply are coupled to the control element (MLDO) through the capacitor. In contrast, compensation capacitor CC1 from FIG. 2A is coupled between nodes N4 and N2, which are not directly coupled to the VDD supply. By referencing the control element (current source IS2) and the compensation capacitor (CC1) from the VDD supply, fast transient performance of the reference circuit (200) are greatly improved over the conventional circuit.

Figure 2B:
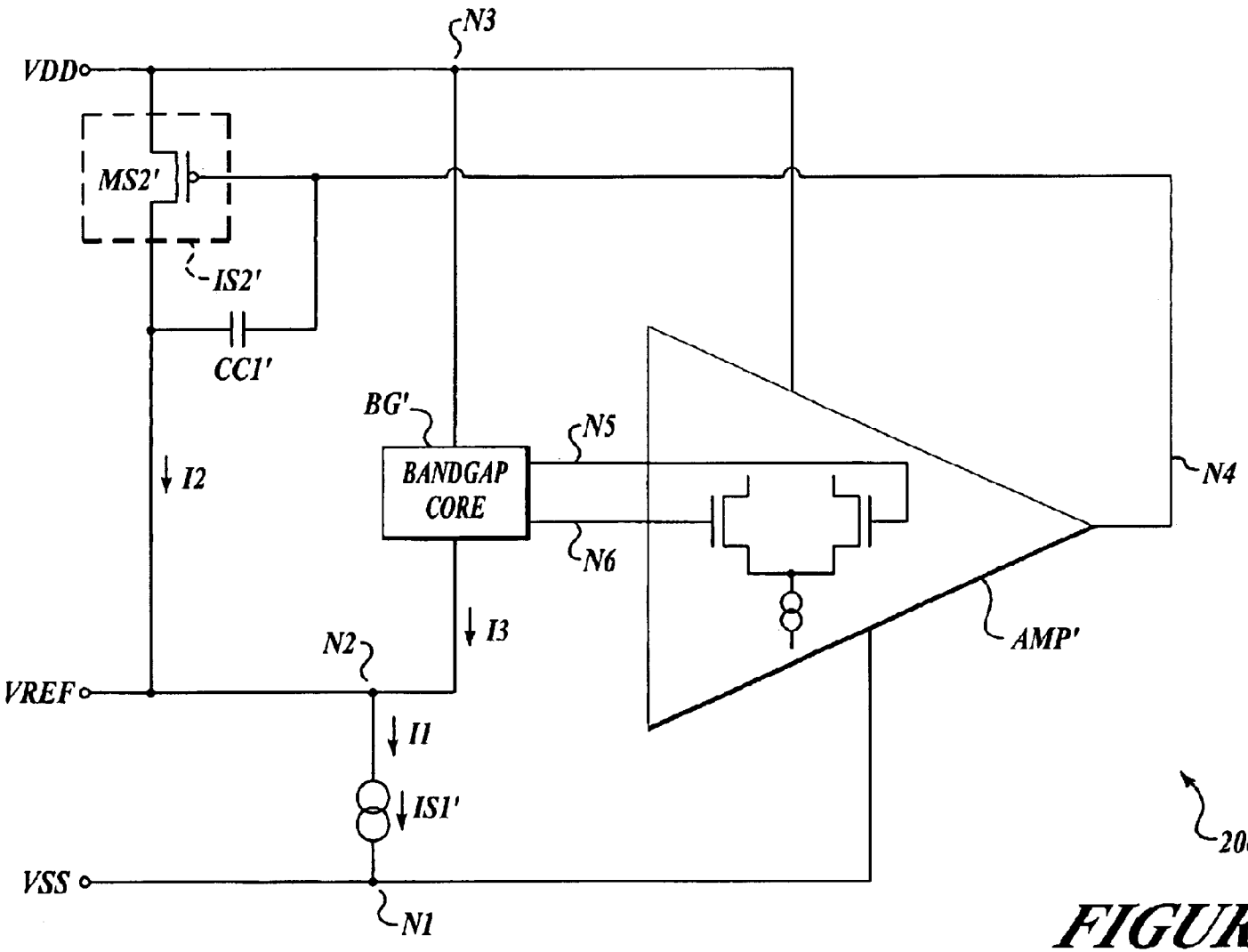
FIG. 2B is an illustrative schematic diagram for a band-gap reference circuit that is arranged in accordance with another embodiment of the present invention.

FIG. 2B is an illustrative schematic diagram for a band-gap reference circuit (200') that is arranged in accordance with an embodiment of the present invention. Circuit 200 includes an amplifier circuit (AMP'), a band-gap core (BG'), a current source (IS1'), a controlled current source (IS2'), and a compensation capacitor (CC1').

Current source IS1' is coupled between nodes N2 and N1. Controlled current source IS2'is coupled between nodes N3 and N2, and responsive to a control signal (CTL') from node N4. Band-gap core BG' is coupled between nodes N3 and N2, and arranged to provide output signals to nodes N5 and N6. Amplifier circuit AMP' is arranged to provide the control signal (CTL') at node N4 in response to the signals from nodes N5 and N6. Node N3 corresponds to a local power supply (e.g., VDD) for reference circuit 200, while node N1 corresponds to another local power supply (e.g., VSS) for the reference circuit. The signal associated with node N2 corresponds to the output of the reference circuit (VREF). Capacitor CC1' is coupled between nodes N2 and N4. Node N3 (the VDD supply) is arranged to operate as a signal ground for the reference circuit.

The example illustrated in FIG. 2B is substantially similar to that shown in FIG. 2A. However, amplifier AMP' includes an n-type FET input stage. Also, the signal ground for the example in FIG. 2B corresponds to the VDD supply, while the VSS supply represents the possible transient/noise source in the system. The circuit illustrated in FIG. 2B operates in substantially the same fashion as that described in FIG. 2A.

Figure 3A:
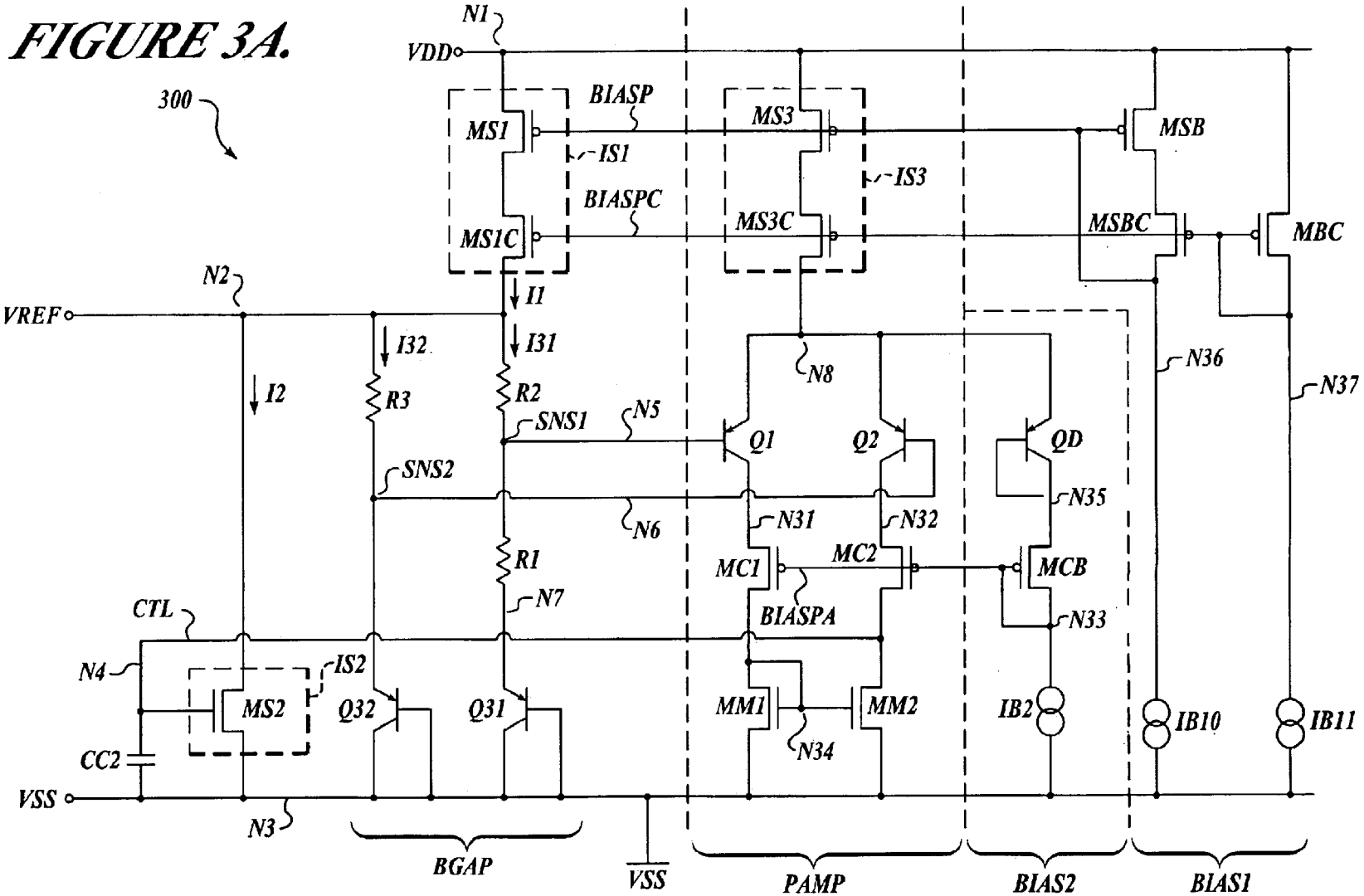
FIG. 3A is a detailed illustrative schematic diagram for a band-gap reference circuit that that is arranged in accordance with still another embodiment of the present invention.

FIG. 3A is a detailed illustrative schematic diagram for a band-gap reference circuit (300) that that is arranged in accordance with still another embodiment of the present invention. Band-gap reference circuit 300 includes an amplifier circuit (PAMP), a band-gap core (BGAP), a current source (IS1), a controlled current source (IS2), a compensation capacitor (CC2), and two bias circuits (BIAS1, BIS2). All of the major circuit components illustrated in FIG. 3A are referenced to the VSS supply such that transient and noise related signals from the VDD supply are minimized.

Band-gap reference circuit 300 is arranged similar to band-gap reference circuit 200. Current source IS1 is coupled between nodes N1 and N2. Controlled current source IS2 is coupled between nodes N2 and N3, and responsive to a control signal (CTL) from node N4. Band-gap core BGAP is coupled between nodes N2 and N3, and arranged to provide output signals (SNS1, SNS2) to nodes N5 and N6. Amplifier circuit PAMP is arranged to provide the control signal (CTL) at node N4 in response to the signals from nodes N5 and N6. Node N1 corresponds to a local power supply (e.g., VDD) for reference circuit 300, while node N3 corresponds to another local power supply (e.g., VSS) for the reference circuit. The signal associated with node N2 corresponds to the output of the reference circuit (VREF). Capacitor CC2 is coupled between node N4 and the VSS supply. Node N3 (the VSS supply) is arranged to operate as a signal ground for the reference circuit (300).

Amplifier circuit PAMP includes transistors Q1, Q2, MC1, MC2, MM1, MM2, and current source IS3. Transistor Q1 includes an emitter that is coupled to node N8, a base that is coupled to node N5, and a collector that is coupled to node N31. Transistor Q2 includes an emitter that is coupled to node N8, a base that is coupled to node N6, and a collector that is coupled to node N32. Transistor MC1 includes a source that is coupled to node N31, a gate that is coupled to node N33, and a drain that is coupled to node N34. Transistor MC2 includes a source that is coupled to node N32, a gate that is coupled to node N33, and a drain that is coupled to node N4. Transistor MM1 includes a source that is coupled to the VSS supply, and a gate and drain that are coupled to node N34. Transistor MM2 includes a source that is coupled to the VSS supply, a gate that is coupled to node N34, and a drain that is coupled to node N4. Current source IS3 is coupled between nodes N1 and N8.

Transistors MC1 and MC2 are configured to operate as cascode transistors that are biased by signal BIASPA, which is provided by bias circuit BIAS2. Bias circuit BIAS2 includes transistors QD and MCB, and current source IB2. Transistor QD includes an emitter that is coupled to node N8, and a base and collector that are coupled to node N35. Transistor MCB includes a source that is coupled to node N35, and a gate and drain that are coupled to node N33. Current source IB2 is coupled between node N33 and the VSS supply.

Band-gap core BGAP includes transistors Q31 and Q32, and resistors R1, R2, and R3. Transistor Q31 includes an emitter that is coupled to node N7, and a base and collector that are coupled to the VSS supply. Transistor Q32 includes an emitter that is coupled to node N6, and a base and collector that are coupled to the VSS supply. Resistor R1 is coupled between nodes N5 and N7. Resistor R2 is coupled between nodes N2 and N5. Resistor R3 is coupled between nodes N2 and N6. Transistors Q31 and Q32 are arranged to operate as diode circuits. However, diode devices may be employed in place of the bipolar junction transistors (BJTs) that are illustrated in FIG. 3A.

Current source IS1 is illustrated as a cascode current source that includes transistors MS1 and MS1C. Current source IS2 is represented as transistor MS2. Current source IS3 is illustrated as a cascode current source that includes transistors MS3 and MS3C. Current sources IS1 and IS3 are referenced to the VDD supply, and biased by signals BIASP and BIASPC. Current source IS2 is referenced to the VSS supply.

Signals BIASP and BIASPC are provided by biasing circuit BIAS1, which includes three transistors (MSB, MSBC, MBC) and two current sources (IB10, IB11). Transistor MSB includes a source that is coupled to node VDD, a gate that is coupled to node N36, and a drain that is coupled to the source of transistor MSBC. Transistor MSBC includes a gate that is coupled to node N37, and a drain that is coupled to node N36. Transistor MBC includes a source that is coupled to VDD, and a gate and drain that are coupled to node N37. Current source IB10 is coupled between node N36 and the VSS supply. Current source IB11 is coupled between node N37 and the VSS supply.

Figure 3B:
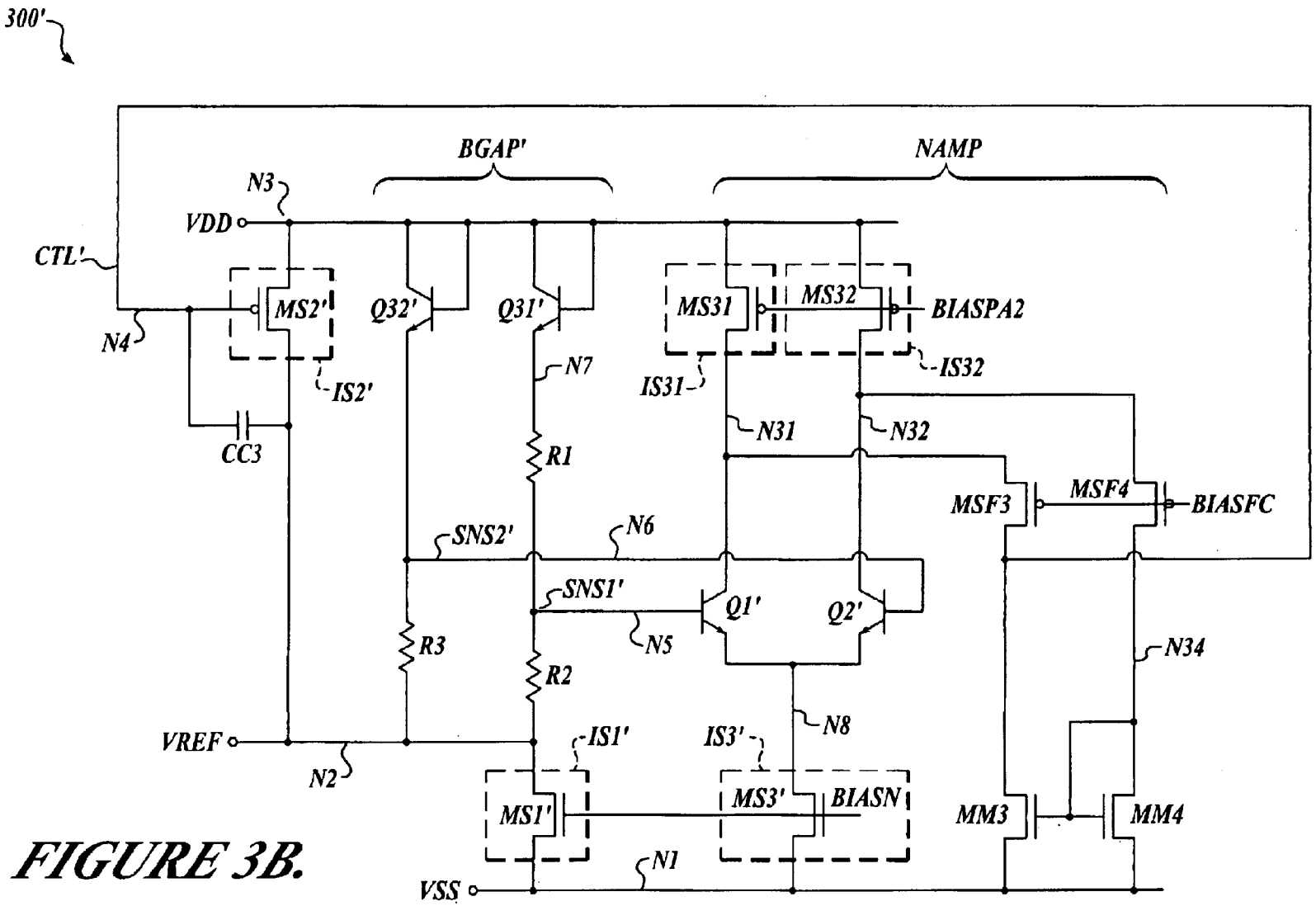
FIG. 3B is a detailed illustrative schematic diagram for a band-gap reference circuit that that is arranged in accordance with yet another embodiment of the present invention.

FIG. 3B is a detailed illustrative schematic diagram for a band-gap reference circuit (300') that that is arranged in accordance with yet another embodiment of the present invention. Band-gap reference circuit 300' includes an amplifier circuit (NAMP), a band-gap core (BGAP'), a current source (IS1'), a controlled current source (IS2'), and a compensation capacitor (CC3). All of the major circuit components illustrated in FIG. 3B are referenced to the VDD supply such that transient and noise related signals from the VSS supply are minimized.

Current source IS1' is coupled between nodes N2 and N1. Controlled current source IS2' is coupled between nodes N3 and N2, and responsive to a control signal (CTL') from node N4. Band-gap core BGAP' is coupled between nodes N3 and N2, and arranged to provide output signals (SNS1', SNS2') to nodes N5 and N6. Amplifier circuit AMP' is arranged to provide the control signal (CTL') at node N4 in response to the signals from nodes N5 and N6. Node N3 corresponds to a local power supply (e.g., VDD) for reference circuit 300', while node N1 corresponds to another local power supply (e.g., VSS) for the reference circuit. The signal associated with node N2 corresponds to the output of the reference circuit (VREF). Capacitor CC3 is coupled between nodes N2 and N4. Node N3 (the VDD supply) is arranged to operate as a signal ground for the reference circuit.

Amplifier circuit NAMP includes transistors Q1', Q2', MSF3, MSF4, MM3, MM4, and current sources IS3', IS31, and IS32. Transistor Q1' includes an emitter that is coupled to node N8, a base that is coupled to node N5, and a collector that is coupled to node N31. Transistor Q2' includes an emitter that is coupled to node N8, a base that is coupled to node N6, and a collector that is coupled to node N32. Transistor MSF3 includes a source that is coupled to node N31 supply, a gate that is coupled to BIASFC, and a drain that is coupled to node N4. Transistor MSF4 includes a source that is coupled to node N32 supply, a gate that is coupled to BIASFC, and a drain that is coupled to node N34. Transistor MM3 includes a source that is coupled to node N1, a gate that is coupled to node N34, and a drain that is coupled to node N4. Transistor MM4 includes a source that is coupled to node N32, and a gate and drain that are coupled to N34. Current source IS3' is coupled between node N8 and the VSS supply. Current source IS31 is coupled between the VDD supply and node N31. Current source IS32 is coupled between the VDD supply and node N32.

Band-gap core BGAP' includes transistors Q31' and Q32', and resistors R1, R2, and R3. Transistor Q31' includes an emitter that is coupled to node N7, and a base and collector that are coupled to the VDD supply. Transistor Q32' includes an emitter that is coupled to node N6, and a base and collector that are coupled to the VDD supply. Resistor R1 is coupled between nodes N5 and N7. Resistor R2 is coupled between nodes N2 and N5. Resistor R3 is coupled between nodes N2 and N6. Transistors Q31' and Q32' are arranged to operate as diode circuits. However, diode devices may be employed in place of the bipolar junction transistors (BJTs) that are illustrated in FIG. 3B.

Current sources IS1', IS2', IS3', IS31, and IS32 are represented as transistors MS1', MS2', MS3', MS31, and MS32, respectively. Transistor MS1'includes a source that is coupled to node N1 (the VSS supply), a gate that is coupled to BIASN, and a drain that is coupled to node N2. Transistor MS3' includes a source that is coupled to node N1, a gate that is coupled to BIASN, and a drain that is coupled to node N8. Transistor MS31 includes a source that is coupled to node N3 (the VDD supply), a gate that is coupled to BIASPA2, and a drain that is coupled to node N31. Transistor MS32 includes a source that is coupled to node N3, a gate that is coupled to BIASPA2, and a drain that is coupled to node N32. Transistors MS1' and MS3' are referenced to the VSS supply, and biased by signal BIASN. Transistor MS2' is referenced to the VDD supply. Transistors MS31 and MS32 are also referenced to the VDD supply, and biased by signal BIASPA2. Signals BIASPA2, BIASFC, and BIASN are provided by additional biasing circuitry (not shown).

The example illustrated in FIG. 3B is substantially similar in arrangement and operation to the other examples described above. However, amplifier NAMP is illustrated as a folded cascode amplifier that includes an n-type bipolar junction transistor (BJT) input stage. Also, the signal ground for the example in FIG. 3B corresponds to the VDD supply, while the VSS supply represents the possible transient/noise source in the system.

For each of the example circuits described above, two current sources (e.g., IS1, IS2) are arranged to cooperate with one another to provide regulation of the band-gap reference signal (e.g., VREF). The first current source (e.g., IS1, IS1') is arranged to provide more current than is necessary for the band-gap core to operate from. The excess current is shunted form the band-gap core by the second current source (e.g., IS2, IS2'). The first current source is a simple current source, with no feedback. The second current source is arranged to cooperate with the amplifier circuit and the band-gap core to provide control over the reference signal (VREF). The settling time of the control loop is greatly improved so that the reference signal settles to a value quickly after a perturbation occurs in the supply line (e.g., VDD).

The addition of cascode transistors in the first current source (e.g., IS1 as illustrated in FIG. 3A) increases the power supply rejection ratio (PSRR) of the current source. Additional cascode transistors can be similarly added to other circuit portions to enhance performance (See e.g., MS3C, MC1, MC2 in FIG. 3A). Moreover, referencing the current mirrors in the amplifier (e.g., MM1/MM2 in FIG. 3A, and MM3/MM4 in FIG. 3B) to the signal ground improves noise and transient rejection in the amplifier.

Illustrative Waveforms

Figure 4A:
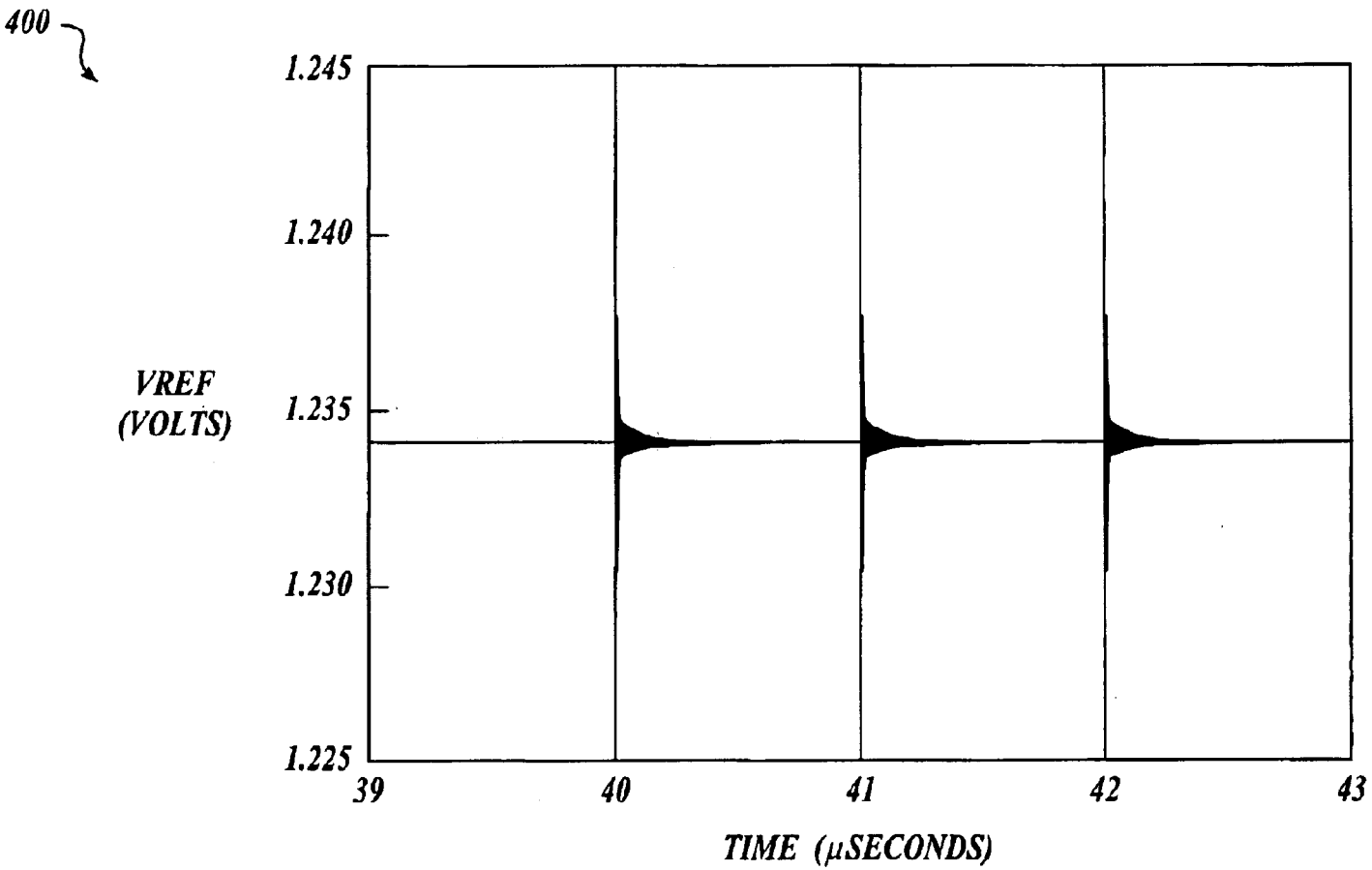
FIGS. 4A and 4B are illustrative waveform diagrams comparing a band-gap reference circuit that is arranged in accordance with an embodiment of the present invention to a conventional band-gap reference circuit.
Figure 4B:
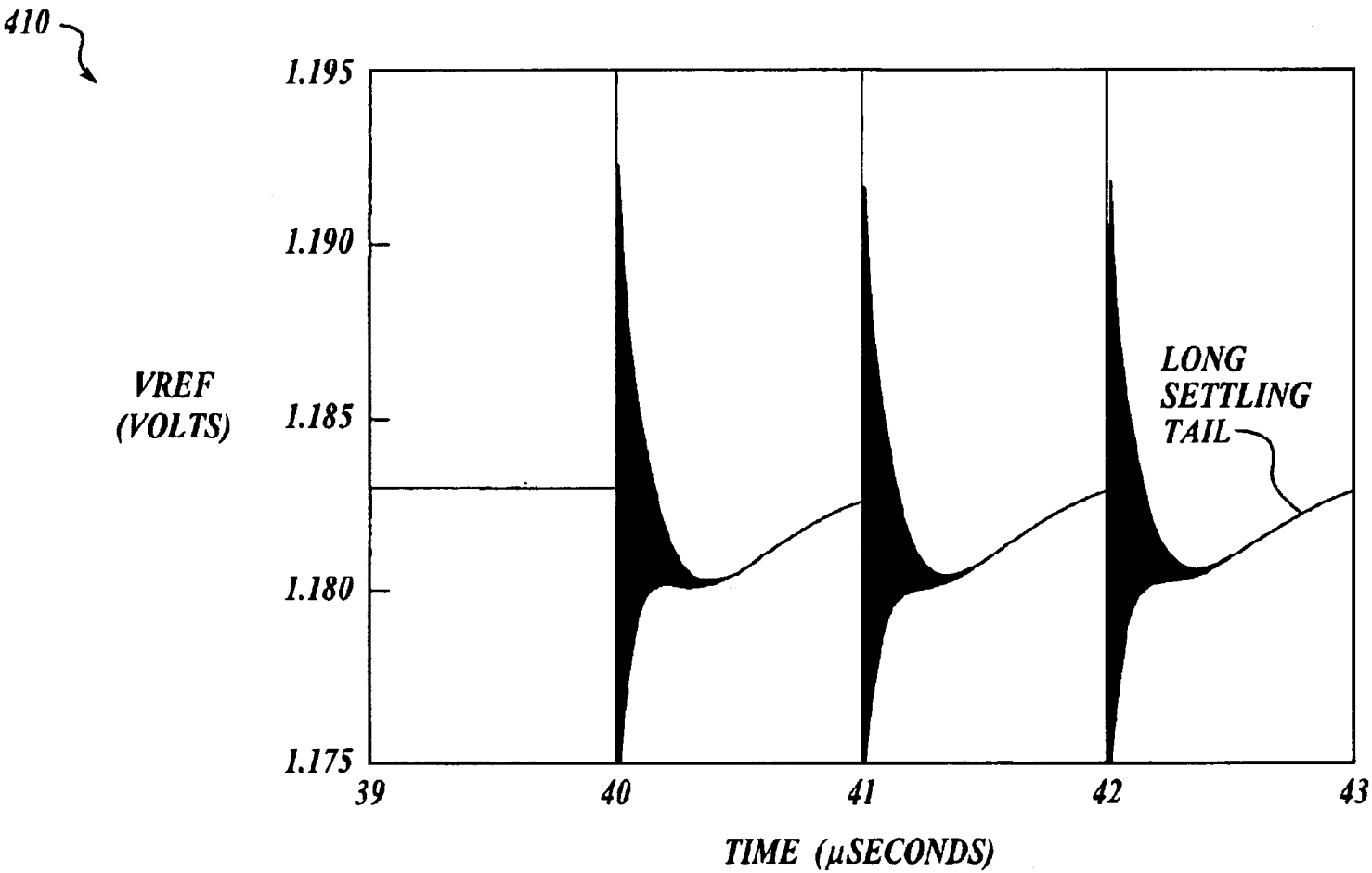

FIGS. 4A and 4B are illustrative waveform diagrams (400, 410) comparing a band-gap reference circuit that is arranged in accordance with an embodiment of the present invention to a conventional band-gap reference circuit. For these example waveforms, a switching regulator arrangement such as shown in FIG. 1 was employed with a switching frequency (e.g., the switching of MSW) on the order of 1 MHz–2 MHz. Each time the regulator switches, current is coupled through connection point 2 to the output circuit creating a disturbance on the local power supply at connection point 5 (the VDD supply).

The reference circuit (XR) from FIG. 1 corresponds to the reference circuit of the present invention for the waveform diagram of FIG. 4A. The reference circuit (XR) from FIG. 1 corresponds to a conventional reference circuit for the waveform diagram of FIG. 4B.

The compensation capacitor (COMP) from the conventional reference circuit of FIG. 5 couples transient disturbances from the VDD supply to the control node (i.e., the gate of MLDO). The output of the error amplifier (EAMP) is limited in slew rate by capacitive loading from the compensation capacitor (COMP) as well as other parasitic capacitances (CPAR). Referring to waveform 410 from FIG. 4B, a perturbation is observable in VREF each time a disturbance in the local power supply (e.g., the VDD supply) occurs. Since the amplifier cannot instantaneously react to the disturbance in the VDD supply, reference signal VREF does not immediately settle to a final value (see long settling tail in waveform 410). Instead, reference signal VREF is shifted away from the desired reference voltage. The shift in reference signal VREF may result in non-optimal switching in the regulator circuit (100) such that the switching regulator has an incorrect output voltage (VOUT). For waveform 410, the disturbance of VREF is manifested as a 200 mV variation for a 1.18V reference voltage, yielding a 17% variation.

The reference circuits of the present invention are compensated without referencing the disturbed power supply (e.g., the VDD supply). By moving the compensation away from the disturbed supply, transient signals are not coupled to control nodes through the compensation capacitor. Moreover, the dual current source arrangement of the present invention (e.g., MS1 and MS2) changes the control loop operation so that the control element (e.g., MS2) is referenced to the signal ground and not the disturbed power supply (e.g., the VDD supply). As illustrated by waveform 400 of FIG. 4A, the disturbance of VREF is manifested as a 20 mV variation for a 1.23V reference voltage, yielding a 1.7% variation. The improved power-supply rejection is on the order of 20 dB using the present invention. More importantly, the reference signal (VREF) settles quickly in waveform 400 such that no long settling tail is observable. The fast setting reference signal provides excellent performance in switching regulators.

The above specification, examples and data provide a complete description of the manufacture and use of the composition of the invention. Since many embodiments of the invention can be made without departing from the spirit and scope of the invention, the invention resides in the claims hereinafter appended.

We claim:

1. An apparatus, comprising:

a current source circuit that is arranged to provide current from a first node to a second node, wherein the first node is associated with a local power supply, and wherein the second node is associated with a reference signal;

a controlled current source circuit that is arranged to selectively sink current from the second node to a third node in response to a control signal from a fourth node, wherein the third node is associated with a signal ground;

a band-gap core circuit that is coupled between the second node and the third node, wherein the band-gap core is arranged to provide a first sense signal to a fifth node and a second sense signal to a sixth node; and an amplifier circuit, wherein the amplifier circuit includes a first input that is coupled to the fifth node, a second input that is coupled to the sixth node, and an output that is coupled to the fourth node.

2. The apparatus of claim 1, wherein the amplifier circuit includes an input stage, wherein the input stage includes at least one of an n-type transistor pair, a p-type transistor pair, a FET type transistor pair, and a BJT type transistor pair.

3. The apparatus of claim 1, the amplifier circuit comprising:

a first transistor that includes an emitter that is coupled to an eight node, a base that is coupled to the fifth node, and a collector that is coupled to the fourth node;

a second transistor that includes an emitter that is coupled to the eight node, a base that is coupled to the sixth node, and a collector that is coupled to an intermediary node;

a third current source that is coupled between the first node and the eight node; and a current mirror that includes a first terminal that is coupled to the fourth node, a second terminal that is coupled to the intermediary node, and a third terminal that is coupled to the signal ground.

4. The apparatus of claim 3, further comprising:

a first cascode transistor that includes a source that is coupled to the collector of the first transistor, a gate that is coupled to a bias signal, and a drain that is coupled to the fourth node such that the first transistor is coupled to the fourth node through the first cascode transistor; and a second cascode transistor that includes a source that is coupled to the collector of the second transistor, a gate that is coupled to the bias signal, and a drain that is coupled to the intermediary node such that the second transistor is coupled to the current mirror through the second cascode transistor.

5. The apparatus of claim 1, the amplifier circuit comprising:

a first transistor that includes a source that is coupled to an eight node, a gate that is coupled to the fifth node, and a drain that is coupled to the fourth node;

a second transistor that includes a source that is coupled to the eight node, a gate that is coupled to the sixth node, and a drain that is coupled to an intermediary node;

a third current source that is coupled between the first node and the eight node; and a current mirror that includes a first terminal that is coupled to the fourth node, a second terminal that is coupled to the intermediary node, and a third terminal that is coupled to the signal ground.

6. The apparatus of claim 1, wherein the amplifier circuit comprises a folded cascode type amplifier.

7. The apparatus of claim 1, the amplifier circuit comprising:

a first transistor that includes an emitter that is coupled to an eight node, a base that is coupled to the fifth node, and a collector that is coupled to a first intermediary node;

a second transistor that includes an emitter that is coupled to the eight node, a base that is coupled to the sixth node, and a collector that is coupled to another intermediary node;

a third current source that is coupled between the first node and the eight node;

a fourth current source that is coupled between the third node and the first intermediary node;

a fifth current source that is coupled between the third node and the second intermediary node;

a current mirror circuit that is referenced to the signal ground;

a first source follower transistor that includes a source that is coupled to the first intermediary node, a gate that is coupled to a biasing signal, and a drain that is coupled to a first terminal of the current mirror circuit; and a second source follower transistor that includes a source that is coupled to the second intermediary node, a gate that is coupled to the biasing signal, and a drain that is coupled to a second terminal of the current mirror circuit, wherein the second terminal of the current mirror circuit corresponds to the fourth node.

8. The apparatus of claim 1, further comprising a compensation capacitor that is coupled between the fourth node and the second node.

9. The apparatus of claim 1, further comprising a compensation capacitor that is coupled between the fourth node and the third node.

10. The apparatus of claim 1, wherein the first current source is a cascode current source.

11. The apparatus of claim 1, the band-gap core comprising:

a first diode circuit that is coupled between the signal ground and a seventh node;

a second diode circuit that is coupled between the signal ground and the sixth node;

a first resistor that is coupled between the fifth node and the seventh node;

a second resistor that is coupled between the second node and the fifth node; and a third resistor that is coupled between the second node and the sixth node.

12. An apparatus as in claim 1, further comprising: a switching transistor that is coupled between the local power supply and an output, wherein the switching transistor is arranged to selectively couple power from the local power supply to the output, wherein a voltage associated with the local power supply is perturbed when the switching means is activated.

13. An apparatus as in claim 1, further comprising:

an control amplifier that is arranged to provide a switching control signal in response to an output signal and the reference signal;

a switching transistor that is coupled between the local power supply and an output, wherein the switching transistor selectively couples power from the local power supply to the output in response to the switching control signal.

14. An apparatus, comprising:

a current source means that is arranged to provide current from a first node to a second node, wherein the first node is associated with a local power supply, and wherein the second node is associated with a reference signal;

a controlled current source means that is arranged to selectively sink current from the second node to a third node in response to a control signal from a fourth node, wherein the third node is associated with a signal ground;

a band-gap core means that is coupled between the second node and the third node, wherein the band-gap core is arranged to provide a first reference signal to a fifth node and a second reference signal to a sixth node; and an amplifier means, wherein the amplifier means includes a first input that is coupled to the fifth node, a second input that is coupled to the sixth node, and an output that is coupled to the fourth node.

15. An apparatus as in claim 14, further comprising:

a coupling means that is arranged to couple power from an input supply to the local power supply; and a switching means that is coupled between the local power supply and an output, wherein the switching means is arranged to selectively couple power from the local power supply to the output, wherein a voltage associated with the local power supply is perturbed when the switching means is activated.

16. An apparatus, comprising:

a first transistor that is arranged to provide a current from a first node to a second node, wherein the first node is associated with a local power supply, and wherein the second node is associated with a reference signal;

a second transistor that is arranged to selectively sink current from the second node to a third node in response to a control signal from a fourth node, wherein the third node is associated with a signal ground;

a band-gap core circuit that i s coupled between the second node and the third node, wherein the band-gap core is arranged to provide a first sense signal to a fifth node and a second sense signal to a sixth node; and an amplifier circuit, wherein the amplifier circuit includes a first input that is coupled to the fifth node, a second input that is coupled to the sixth node, and an output that is coupled to the fourth node.

17. The apparatus of claim 16, further comprising a first cascode transistor that is coupled between the first transistor and the second node.

18. The apparatus of claim 16, the band-gap core circuit comprising: a first diode circuit that is coupled between the signal ground and a seventh node, a second diode circuit that is coupled between the signal ground and the sixth node, a first resistor that is coupled between the fifth node and the seventh node, a second resistor that is coupled between the second node and the fifth node, and a third resistor that is coupled between the second node and the sixth node; and the amplifier circuit comprising: a differential pair circuit, a current mirror circuit, and a third current source, wherein the differential pair circuit includes inputs at the fifth and sixth nodes, a common node at an eight node, and outputs at first and second intermediary nodes, wherein the current source circuit is coupled to the common node, wherein the current mirror circuit is coupled to the first and second intermediary nodes, and wherein the current mirror circuit is referenced to the signal ground.

19. The apparatus of claim 18, further comprising:

a first cascode transistor that is coupled between the differential pair circuit and the first intermediary node; and a second cascode transistor that is coupled between the differential pair circuit and the second intermediary node.

20. The apparatus of claim 19, further comprising:

a first diode connected transistor that is coupled between the common node and a third intermediary node;

a second diode connected transistor that is coupled between the third intermediary node and a fourth intermediary node; and a fourth current source that is coupled between the fourth intermediary node and the third node, wherein the first diode connected transistor, the second diode connected transistor, and the fourth current source are arranged to operate a sa biasing circuit for the first and second cascode transistors.

* * * * *

UNITED STATES PATENT AND TRADEMARK OFFICE

CERTIFICATE OF CORRECTION

PATENT NO. : 6,998,830 B1
APPLICATION NO. : 10/619945
DATED : February 14, 2006
INVENTOR(S) : Paul M. Henry et al.

It is certified that error appears in the above-identified patent and that said Letters Patent is hereby corrected as shown below:

Column 1, Line 43: "a 60 mV difference" should read --a 60mV difference--.

Column 2, Line 20: "EMBODIMENTS" should read --EMBODIMENT--.

Column 3, Line 46: "output current (1o)" should read --output current (Io)--

Column 3, Line 60: "LWBI when switching" should read --LWB1 when switching--

Column 9, Line 10: "a 20 mV variation" should read --a 20mV variation--

Column 9, Line 12: "order of 20 dB" should read --order of 20dB--

Column 12, Line 30: "node at an eight" should read --node at an eighth--

Signed and Sealed this

Eighth Day of August, 2006

JON W. DUDAS
*Director of the United States Patent and Trademark Office*